US006728508B2

(12) United States Patent
Kabashima et al.

(10) Patent No.: US 6,728,508 B2
(45) Date of Patent: Apr. 27, 2004

(54) IMAGE FORMING APPARATUS WITH BLADE AND BRUSH CLEANING SECTION

(75) Inventors: Hirotaka Kabashima, Tachikawa (JP); Azusa Nakamura, Hino (JP)

(73) Assignee: Konica Corporation, Tokyo (JP)

( * ) Notice: Subject to any disclaimer, the term of this patent is extended or adjusted under 35 U.S.C. 154(b) by 0 days.

(21) Appl. No.: 10/456,241

(22) Filed: Jun. 5, 2003

(65) Prior Publication Data

US 2003/0231910 A1 Dec. 18, 2003

(30) Foreign Application Priority Data

Jun. 13, 2002 (JP) ..... 2002-172196

(51) Int. Cl.[7] ..... G03G 21/00
(52) U.S. Cl. ..... 399/349; 399/353
(58) Field of Search ..... 399/349, 353, 399/354, 355; 430/125

(56) References Cited

U.S. PATENT DOCUMENTS 6,415,129 B2 * 7/2002 Sawayama ..... 399/353
6,442,367 B1 * 8/2002 Itami et al. ..... 399/349

FOREIGN PATENT DOCUMENTS

JP 60-168182 A * 8/1985
JP 5-241483 A * 9/1993

* cited by examiner

*Primary Examiner*—Joan Pendegrass
(74) *Attorney, Agent, or Firm*—Frishauf, Holtz, Goodman & Chick, P.C.

(57) ABSTRACT

An image forming apparatus having a photoreceptor, a developing section, a transferring section, and a cleaning section, wherein the toner is manufactured by a polymerization method, particle diameter is 3–8 $\mu$m, and a shape factor of the toner is 0.940–0.985. The cleaning section has a rubber blade, and a brush roller implanted with brush fibers, wherein a value of effective rubbing force F, defined by the following expression, of brush fibers is in a range of 2.5–10.5, $$F=nxyEt^3/L^3,$$

wherein,

"n" represents implanted density of the brush fibers (fibers/mm$^2$), "x" represents a linear speed difference between the brush fibers and the photoreceptor (mm/s), "y" represents an encroaching amount (mm) of the brush fibers upon the photoreceptor, "E" represents Young's modulus (kgf/mm$^2$), "t" represents a diameter (mm), and "L" represents a free length (mm) of the brush fibers.

8 Claims, 1 Drawing Sheet

IMAGE FORMING APPARATUS WITH BLADE AND BRUSH CLEANING SECTION

BACKGROUND OF THE INVENTION

The present invention relates to an electrophotographic image forming apparatus.

(Prior Art)

In an electrophotographic image forming method used in, for example, a copying machine or a printer, generally a photoreceptor to be rotated is electrostatically charged evenly, then, exposure processing corresponding to an image of a document is conducted to form a latent image which is developed by toner, and a toner image thus formed is transferred onto a recording material, thus, the transferred image is fixed on the recording material to be formed as an aimed image.

However, in the process of transferring a toner image, all toner particles on the surface of the photoreceptor are not always transferred onto the recording material completely, and some of the toner particles stay on the surface of the photoreceptor inevitably. A cleaning means is one to remove the residual toner on the surface of the photoreceptor.

Up to now, methods to employ a fur brush roller, a magnetic brush roller or a blade have been typical as a cleaning means, and in particular, a method to use a blade composed of a rubber plate (hereinafter referred to as "rubber blade") has been used commonly because it has a simple structure and offers good cleaning results.

Further, in the image forming method stated above, there have been studied various means, for improving reproducibility of fine lines and dots in a formed visible image and for achieving improvement of image quality, and for preventing image defects called black lines on copy and smeared image which are caused by cleaning failure.

For example, when forming an image by fine lines or dots of a digital image, there are used toner particles each has been made small in terms of particle size, for achieving improvement of image quality. As a method to obtain toner particles which have been made small, there is known a method to manufacture toner by means of the so-called polymerization method. However, with respect to toner manufactured by the polymerization method, its particle is closer to a globular shape and is smaller in terms of a diameter, compared with toner particles manufactured by a powdering method. Therefore, it is difficult to remove residual toner on the surface of the photoreceptor sufficiently, resulting in image defects such as background dirt and black lines on copy caused by cleaning failure which easily occur on a visible image to be formed, and this has been a problem.

On the other hand, as a means to make toner itself to be one which can be removed easily, a technology to add fatty acid metal salt such as zinc stearate and calcium stearate to toner has been widely put to practical use, and in this technology, considerable-effects can be obtained even for the toner manufactured by a polymerization method.

However, when toner to which fatty acid metal salt is added is used, a thin film of fatty acid metal salt is formed on the surface of the photoreceptor. Therefore, surface of the photoreceptor is made not to be worn out, paper dust tends to stick to the surface of the photoreceptor, and under the high humidity, image defects called "smeared image" are caused by a flow of electric charges on the surface of the photoreceptor resulted from absorption of moisture in the paper dust.

(Problems to be Solved by the Invention)

An object of the invention is to provide an image forming apparatus capable of forming constantly a visible image with high image quality which is free from image defects, by using specific toner manufactured by a polymerization method and by employing a cleaning means equipped with a brush roller operated under the specific condition, in an electrophotographic image forming apparatus.

SUMMARY OF THE INVENTION

The object of the invention mentioned above can be attained by taking the following structures.

An image forming apparatus having the structure in which a latent image formed on a rotating photoreceptor is developed by toner, then, a toner image thus formed is transferred onto a recording material to be fixed thereon, and residual toner on the photoreceptor is removed by a cleaning means, wherein the toner is one that is manufactured through a method in which a polymerizable monomer is polymerized in an aqueous medium, and has a number average particle diameter in a range of 3–8 $\mu$m and a shape factor in a range of 0.940–0.985, the cleaning means has therein a rubber blade that comes in contact with the photoreceptor surface and a brush roller that is implanted with brush fibers and is rotated while it is in contact with the photoreceptor under the state of having a linear speed difference against the photoreceptor, and the brush roller has effective rubbing force "F" of a brush fiber group touching the photoreceptor that is expressed by the following expression (1) and has a value in a range of 2.5–10.5;

$$F=nxyEt^3/L^3 \qquad \text{Expression (1)}$$

Wherein,

"n" represents implanted density of brush fibers (bristles/mm$^2$),

"x" represents a linear speed difference between the brush fibers and the photoreceptor (mm/s), "y" represents an amount of encroaching (mm) of the brush fiber upon the photoreceptor, "E" represents Young's modulus (kgf/mm$^2$) of the brush fiber, "t" represents a diameter (mm) of the brush fiber, and "L" represents a free length (mm) of the brush fiber.

The image forming apparatus of the invention make it possible to form constantly a visible image with high image quality which is free from image defects, by using toner satisfying the aforementioned conditions and by employing a cleaning means equipped with a brush roller operated under the condition stated above.

DETAILED DESCRIPTION OF THE PREFERRED EMBODIMENT

Figure 1:
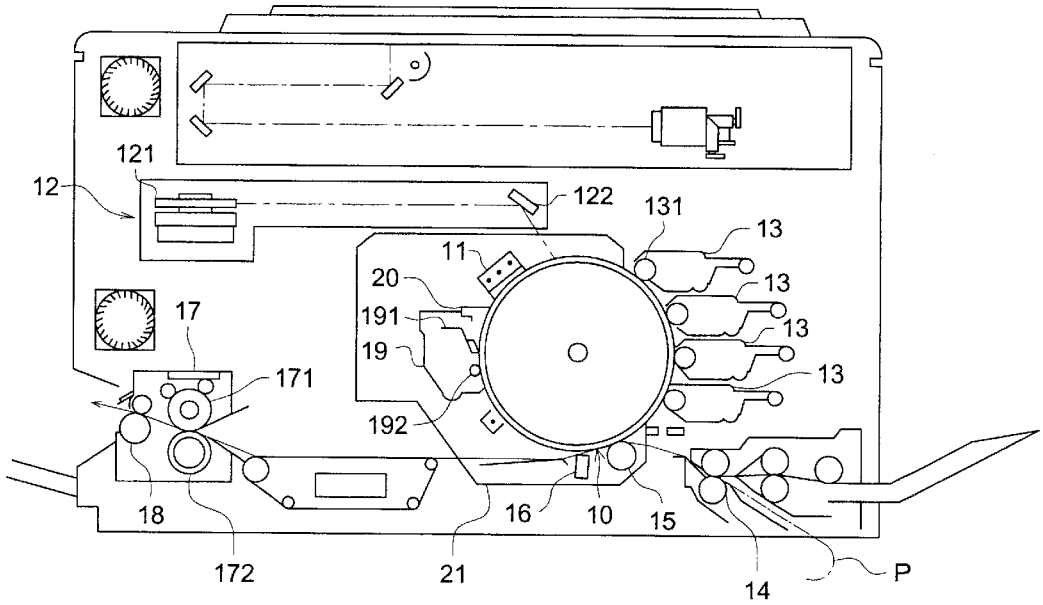
FIG. 1 is an illustration showing an example of the structure of an image forming apparatus.

The invention will be explained in detail as follows, referring to the drawings.

FIG. 1 is an illustration showing an example of the structure of an image forming apparatus. In FIG. 1, photoreceptor 10 is driven to rotate clockwise. Uniform electrostatic charges are given by charging unit 11 to the photoreceptor 10 through corona discharging. It is preferable that exposure is conducted, prior to a charging means, on the photoreceptor 10 by exposure section 20 composed of a light-emitting diode, and thereby, the photoreceptor 10 is neutralized.

After the photoreceptor 10 is charged by charging unit 11, exposure is conducted by imagewise exposure unit 12 based on image signals. The imagewise exposure unit 12 in this example has an unillustrated laser diode as a light source for exposure, and the light emitted from the light source, then, passes through rotating polygon mirror 121 and fθ lens and deflected in terms of its light path by reflection mirror 122 scans on the photoreceptor for the imagewise exposure by which a latent image is formed.

The latent image is developed by developing units 13. Along the circumstance of the photoreceptor 10, there are provided developing units 13 each housing therein a developing agent containing carrier and each of yellow (Y), magenta (M), cyan (C) and black (K) toners. Carrier in the developing agent is one wherein insulating resin is coated on the surface of a core composed of ferrite, for example, while, toner is one wherein pigment, charge controlling agent, silica and titanium oxide are added to the main material, for example, of styrene acrylic copolymer or polyester. The developing agent is made to be a developing agent layer having a layer thickness regulated to be 100–600 $\mu$m on developing sleeve 131 by an unillustrated layer forming means, and is conveyed to a developing area.

Developing is conducted when DC and/or AC bias voltage is impressed between photoreceptor 10 and developing sleeve 131 that houses a magnet and rotates while holding thereon developing agent.

When forming a color image, an image forming process for the second color is started after the developing for the first color has been completed. Namely, uniform charging is conducted by charging unit 11 again, then, a latent image for the second color is formed by imagewise exposure unit 12, and the latent image is developed by developing unit 13. For each of the third and fourth colors, the same image forming as in the second color is conducted. As a result, toner images respectively for four colors are formed to be superposed on the circumferential surface of the photoreceptor 10. When forming a monochromatic image, an image is formed through a single developing by a developing agent with black toner.

Recording material P is supplied to a transfer area by rotation of sheet-feeding roller 14. In the transfer area, the recording material P supplied between the circumferential surface of the photoreceptor 10 and transfer roller 15 that is brought into pressure contact with the photoreceptor 10 is interposed and a toner image is transferred onto the recording material P. In the aforementioned explanation, there has been described a method wherein four toner images each having a different color were formed on photoreceptor 10, and a color image is formed on the recording material P through a single transferring. However, the invention is not limited to this method. Namely, a toner image may be formed on the photoreceptor and is transferred onto a recording material for one different color in succession, so that each toner image is superposed to form a color image on the recording material. In addition, an intermediate transfer material may be used. Further, an apparatus to form an image with only one color is also included in the invention.

Recording material P onto which a toner image has been transferred is neutralized by separation brush 16, then, is separated from the circumferential surface of photoreceptor 10, and is conveyed to fixing unit 17 where toner on the recording material is fixed by heat and pressure exerted respectively by heating roller 171 and pressure roller 172, to be conveyed out of the apparatus by sheet-ejection roller 18. After the recording material P has passed, the transfer roller 15 and the separation brush 16 retreat from the circumferential surface of photoreceptor 10, to be ready for the succeeding transfer of a toner image.

When the photoreceptor 10 from which the recording material P has been separated is rubbed by rubber blade 191 and brush roller 192 which are in pressure contact with the photoreceptor 10, toner remaining on the surface of the photoreceptor is removed, and then, the photoreceptor is charged by charging unit 11 again, and the succeeding image forming is started. In the case of forming a color image, rubber blade 191 and brush roller 192 move immediately after cleaning of the surface of the photoreceptor to retreat from the circumferential surface of the photoreceptor 10.

As recording material P, there are generally used papers such as a plain paper, a neutralized paper and an acid paper as well as a plastic support such as a polyester base, to which, however, the invention is not limited.

Cartridge 21 is one in which photoreceptor 10, charging unit 11, transfer unit 15, separation unit 16 and cleaning unit 19 are integrated solidly, and it can be mounted on and dismounted from the main body of the apparatus. The cartridge 21 may further be one in which photoreceptor 10, developing unit 13 and cleaning unit 19 are integrated solidly, and it may also be of the structure wherein photoreceptor 10 and at least one of charging unit 11, exposure unit 12, developing unit 13, transfer unit 15, separation unit 16 and cleaning unit 19 are integrated solidly to be mounted and dismounted by using a guide means such as an unillustrated rail of the apparatus main body.

In the image forming apparatus used as a copying machine or a printer, exposure is conducted by applying reflected light or transmitted light from a document on photoreceptor 10, or by applying the light on photoreceptor 10 by reading a document with a sensor to make it a signal, by scanning laser beam based on the signal, by driving LED array, or by driving liquid crystal shutter array. In the image forming apparatus used as a printer of a facsimile machine, exposure is conducted when imagewise exposure unit 12 applies light on photoreceptor 10 in accordance with receiving data.

Toner used in the invention is one whose number average particle diameter is in a range of 3–8 $\mu$m. By using toner whose number average particle diameter is in a range of 3–8 $\mu$m, it is possible to reduce the presence of toner having excessive adhesion to recording material P and toner having weak adhesive force, thus, stable developability can be obtained for a long time and high transfer efficiency can be obtained, and therefore, image quality of half tone is improved, and an image with improved image quality for fine lines and dots is formed.

A value of a shape factor of a toner particle represents an element which is defined as follows and shows a degree of sphericity of a toner particle. Namely, a flow type particle image analyzing instrument "FPIA-2000" (made by SYSMEX CORPORATION) is used, and a toner particle in a toner suspension is photographed by a CCD camera, then, circumference length "a" of a toner particle photo image thus obtained and circumference length "b" of a circle having the same area as in toner particle photo image are obtained, and the value stated above is defined as a quotient "b/a" obtained by dividing a value of "b" with a value of "a".

This value of the shape factor becomes 1 if the toner particle is a real sphere, and it becomes smaller if a degree of irregularity of the particle grows greater.

In the invention, toner whose shape factor is in a range of 0.940–0.985 is used, and what is used preferably in particular is one whose shape factor is in a range of 0.950–0.975. In the case of toner having a shape factor that is greater than 0.985, its particle is substantially a real sphere, causing poor cleaning performance of the toner, and it is difficult to eliminate cleaning failure even when the cleaning means of the invention is used. On the other hand, when the shape factor is smaller than 0.940, irregularity of a particle grows greater to make the particle to be destroyed easily by pressure in the apparatus, and a toner particle is not charged evenly in the developing unit. Thus, excellent images are not formed.

As a typical method to manufacture the toner stated above, there are available a suspension polymerization method and an emulsion polymerization association method in which an organic solvent and a flocculating agent are added to fine-grains obtained by emulsion polymerization for association.

Cleaning unit 19 for removing a residual toner staying on the surface of the photoreceptor from which recording material P has been separated is composed of rubber band 191 and brush roller 192 that is arranged at the upstream side of the rubber blade 191 in the rotation direction of the photoreceptor. The brush roller 192 scrapes off the greater part of the residual toner staying on the surface of the photoreceptor from which recording material P has been separated, and the rubber blade 191 has a function to scrape off the toner failed to be removed by the brush roller.

Figure 2:
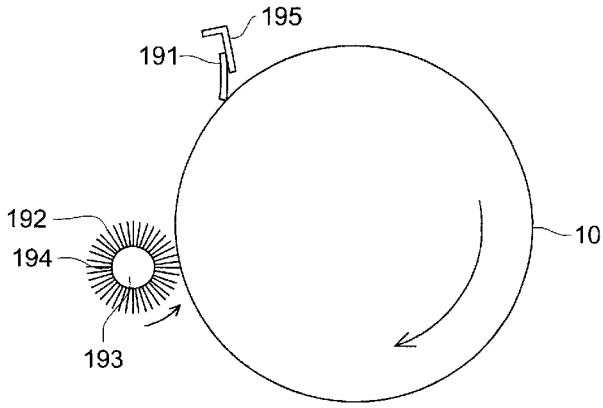
FIG. 2 is a substantial diagram showing the structure of a photoreceptor, a brush roller and a rubber blade.

The rubber blade 191 is provided so that it has its free end on supporting member 195 as shown in FIG. 2, and this free end is arranged so that it may extend in the direction opposite to the rotation direction of the photoreceptor 10 (counter direction) to be brought into pressure contact.

It is preferable that hardness of the rubber blade 191 is 65–80°, impact resilience thereof is 50% or more, blade load for the rubber blade 191 is 10–30 gf/cm and an effective contact angle thereof is 7–20°.

The brush roller 192 is composed of cylindrical brush base 193 and brush fiber 194 flocked on this brush base 193.

As a material of the brush base 193, there are used metal such as stainless steel and aluminum as well as paper and plastic mainly, to which, however, the invention is not limited.

It is preferable that a material of the brush fiber 194 is a fiber forming high molecule polymer which is hydrophobic and has a high dielectric constant. As a high molecule polymer of this kind, there are given, for example, rayon, nylon, polycarbonate, polyester, resin methacrylate, acrylic resin, polyvinylchrolide, polyvinylidenchrolide, polypropylene, polystyrene, polyvinylacetate, styrene-butadiene copolymer, vinylidene chloride-acrylonitrile copolymer, silicone resin, silicone alkyd resin, phenol-formaldehyde resin, styrene-alkyd resin and polyvinyl acetate (for example, polyvinyl butyral). These resins can be used independently or in combination of two or more kinds. In particular, it is preferable that either of rayon, nylon, polyester, acrylic resin and polypropylene is used as a material of a brush section.

It is preferable that electric resistance of the brush fiber 194 is $10^{10}$ Ω.cm or less. When the electric resistance of the brush fiber 194 is greater than this value, neutralizing of toner by the brush fiber 194 is not conducted sufficiently, and electrostatic adhesiveness of toner to photoreceptor 10 cannot be reduced accordingly. Thus, an amount of residual toner to be removed by the brush roller 192 is reduced.

Implanted density "n" in a range of 50–200 bristles/mm$^2$ is preferable for the brush fiber 194. Further, brush fiber diameter "t" in a range of 0.01–0.05 mm and brush fiber free length "L" in a range of 3–10 mm are preferable.

An amount of encroaching "y" of brush fiber 194 upon photoreceptor 10 that is in a range of 0.5–1.5 mm is preferable. In this case, an amount of encroaching "y" of the brush fiber upon photoreceptor 10 is defined as the maximum value by which the tip of the brush fiber encroaches upon photoreceptor 10 when the photoreceptor 10 is not present. Namely, the expression "y=r1+r2+s1−s2" holds under the assumption where r1 represents a radius of a photoreceptor, r2 represents a radius of brush base 193, s1 represents a length of a brush fiber and s2 represents a distance between a center of the brush base and a center of the photoreceptor.

Young's modulus E of the brush fiber that is in a range of 500–1000 kgf/mm$^2$ (4900–9800 N/m$^2$) is preferable.

A member (flicker) for flicking residual toner sticking to the brush may be provided on brush roller 192 as occasion demands.

It is preferable that the brush roller 192 is rotated in the direction opposite to the rotation direction of photoreceptor 10 so that a portion of the brush roller that is in contact with photoreceptor 10 may move in the same direction at the speed which creates a range of 20–500 mm/s of the linear speed difference between photoreceptor 10 and the brush roller.

Effective rubbing force f per one bristle of brush fiber that is in contact with the photoreceptor is expressed by the following expression (2).

$$f=ayEt^3/L^3 \qquad \text{Expression (2)}$$

(In the expression (2), a represents a constant.)

Effective rubbing force F of a group of brush fibers which are in contact with the photoreceptor represents a product obtained by multiplying the effective rubbing force "f" per one bristle of brush fiber that is in contact with the photoreceptor by the implanted density "n" of brush fibers and by the number of times of rubbing between the brush fibers and the photoreceptor per unit of time, and it is expressed by the aforementioned expression (1).

When a value of effective rubbing force F is in a range of 2.5–10.5, electrostatic or physical adhesion force of residual toner rubbed and disturbed by the brush roller to the photoreceptor is lowered, and the toner is scraped off by the brush roller highly efficiently. Thus, an amount of toner arriving at the rubber blade is reduced and the rubber blade can scrape off the toner easily. Due to this, abrasion of the rubber blade caused by toner is decreased, and image defects called black lines on copy may be prevented for a long time accordingly.

Further, when a value of effective rubbing force F is in a range of 2.5–10.5, the surface of the photoreceptor is worn away moderately by the brush roller, and adhesion of paper dust on the surface, for example, is reduced, and occurrence of troubles called the smeared image under the high humidity can be prevented.

When a value of effective rubbing force F is smaller than 2.5, force of the brush roller for rubbing on the photoreceptor is weak, which does not sufficiently reduce the amount of toner arriving at the rubber blade. Therefore, abrasion of the rubber blade caused by the toner grows greater, and image defects called black lines on copy are likely to be caused.

On the other hand, when a value of effective rubbing force F is greater than 10.5, force of the brush roller for rubbing on the photoreceptor is excessively great, and therefore, the surface of the photoreceptor is worn away excessively, a surface of the photoreceptor becomes rough, and cleaning failure tends to be caused. In addition, since a rate of removing toner by the brush roller is too high, there are caused troubles such as toner to be supplied to the rubber blade is insufficient, friction force between the photoreceptor and the rubber blade is too large, an edge of the rubber blade is damaged, the rubber blade is everted, or bounding is caused, resulting in easy occurrence of cleaning failure.

(Example of the Embodiment)

The invention will be explained specifically as follows, referring to the examples, to which, however, the invention is not limited.

(Example of Toner Manufacture 1: Example of Emulsion Polymerization Association Method)

Some 1.20 kg of carbon black "Regal330R" (made by CABOT Co.) was added slowly to the solution obtained by stirring and dissolving 0.90 kg of sodium n-dodecyl sulfate in 10.0 L of pure water, then, they were stirred sufficiently for one hour, and continuous dispersing processing was conducted for 20 hours by the use of a sand grinder (media type homogenizer), to obtain coloring agent dispersed solution 1.

On the other hand, anion surfactant solution A was obtained by dissolving 0.055 kg of sodium dodecylbenzenesulfonate in 4.0 L of ion-exchange water. In addition, Nonion surfactant solution B was obtained by dissolving 0.014 kg of aduct of nonylphenol with 10 mol of polyethylene oxide in 4.0 L of ion-exchange water. Further, initiator solution C was obtained by dissolving 223.8 g of potassium persulfate in 12.0 L of ion-exchange water.

Some 3.41 kg of wax emulsion, anion surfactant solution A and Nonion surfactant solution B were put in the glass-lining reaction kettle having a capacity of 100 L equipped with a temperature sensor, a cooling pipe and a nitrogen introducing device, and stirring was started. Then, 44.0 L of ion-exchange water was added.

Wax emulsion was polypropylene emulsion with number average molecular weight of 3000, while, its number average particle diameter was 120 nm and solid matter concentration was 29.9%.

Heating was started, and when the temperature of the solution is raised up to 75° C., initiator solution C was added to the solution through dripping. After that, a mixture including 12.1 kg of styrene, 2.88 kg of n-butyl acrylate, 1.04 kg of methacrylic acid and 548 g of t-docecyl mercaptan was put in the solution through dripping, while keeping the solution temperature at 75° C.±1° C. After completion of the dripping, the solution temperature was raised to 80° C.±1° C., and the solution was heated and stirred for 6 hours. Then, the solution temperature was lowered down to 40° C. or less and stirring was stopped, thus, latex 1-A was obtained by filtering with a pole filter.

The glass transition temperature of a resin particle of the latex 1-A was 57° C., the softening point was 121° C., weight average molecular weight was 12700 and the weight average particle diameter was 120 nm.

On the other hand, anion surfactant solution D was obtained by dissolving 0.055 kg of sodium dodecylbenzenesulfonate in 4.0 L of ion-exchange water. In addition, Nonion surfactant solution E was obtained by dissolving 0.014 kg of aduct of nonylphenol with 10 mol of polyethylene oxide in 4.0 L of ion-exchange water. Further, initiator solution F was obtained by dissolving 200.7 g of potassium persulfate in 12.0 L of ion-exchange water.

Some 3.41 kg of wax emulsion, anion surfactant solution D and Nonion surfactant solution E were put in the glass-lining reaction kettle having a capacity of 100 L equipped with a temperature sensor, a cooling pipe, a nitrogen introducing device and a comb baffle, and stirring was started. Then, 44.0 L of ion-exchange water was added.

Wax emulsion was polypropylene emulsion with number average molecular weight of 3000, while, its number average of primary particle diameter was 120 nm and solid matter concentration was 29.9%.

Heating was started, and when the temperature of the solution is raised up to 70° C., initiator solution F was added to the solution. Then, a solution of the mixture including 11.0 kg of styrene, 4.00 kg of n-butyl acrylate, 1.04 kg of methacrylic acid and 9.02 g of t-docecyl mercaptan was dripped. After completion of the dripping, the solution temperature was controlled at 72° C.±2° C., and heating and stirring were conducted for 6 hours. Further, the solution temperature was raised to 80° C.±2° C. and heating and stirring were conducted for 12 hours. Then, the solution temperature was lowered down to 40° C. or less and stirring was stopped, thus, latex 1-B was obtained by filtering with a pole filter.

The glass transition temperature of a resin particle in the latex 1-B was 58° C., the softening point was 132° C., weight average molecular weight was 245000 and the weight average particle diameter was 110 nm.

On the other hand, sodium chloride solution G was obtained by dissolving 5.36 kg of sodium chloride in 20.0 L of ion-exchange water. Further, Nonion surfactant solution H was obtained by dissolving 1.00 g of fluorine type Nonion surfactant in 1.00 L of ion-exchange water.

Some 20.0 kg of latex 1-A, 5.2 kg of latex 1-B, 0.4 kg of coloring agent dispersed solution 1 and 20.0 kg of ion-exchange water were put in the stainless steel reaction kettle having a capacity of 100 L equipped with a temperature sensor, a cooling pipe, a nitrogen introducing device and a monitoring device that monitors a diameter and a form of a generated particle, to be stirred. Then, the solution prepared in the foregoing was heated to 40° C., and sodium chloride solution G, 6.00 kg of isopropanol and Nonion surfactant solution H were added to the aforesaid solution in this order. Then, after they were left for 10 minutes, a temperature rise was started, and the solution temperature was raised to 85° C. in 60 minutes. Then, the solution was heated and stirred for 0.5–3 hours while it was kept at 85° C.±2° C., so that a particle diameter might be grown during the course of salting-out and fusing, then, growth of a particle diameter was stopped by adding 2.1 L of pure water, thus, the fused particle dispersed solution was obtained.

Some 5/0 kg of the fused particle dispersed solution was put in the reaction kettle having a capacity of 5 L equipped with a temperature sensor, a cooling pipe and a monitoring device for monitoring a diameter and a form of a particle, to be heated and stirred for 0/5–15 hours at the solution temperature of 85° C.±2° C. After that, the solution was cooled down to 40° C. or less and stirring was stopped, then, classification was conducted in the solution through the centrifugal sedimentation method by the use of a centrifugal separator, and a screen having a sieve opening of 45 $\mu$m was used for filtering to obtain association solution 1. Then, an aspheric particle in a form of a wet cake was obtained from the association solution 1 through filtering, by the use of Nutsche, and it was washed by ion-exchange solution.

The aspheric particle was dried at the in-let air temperature of 60° C. by the use of a flash jet drier, and then, was dried at the temperature of 60° C. by the use of a fluid bed drier. One part by weight of silica fine grains was added to and mixed with 100 parts by weight of the coloring particles thus obtained by Henschel mixer and thus, the toner by an emulsion polymerization association method was obtained.

To be concrete, by controlling the speed of rotation for stirring and heating time in the stage of the salting-out/fusing and of monitoring the process of form control, and thereby, by controlling a form and a change of the form, and further, by controlling a particle size and fluctuations of particle size distribution by classification in the solution, there were obtained toner 1 shown in the following table and toner a and toner b both for comparison.

(Example of Toner Manufacture 2: Example of Suspension Polymerization Method)

Some 165 g of styrene, 35 g of n-butyl acrylate, 10 g of carbon black, 2 g of di-t-butyl salicylic acid metal compound, 8 g of styrene-methacrylic acid copolymer and 20 g of paraffin wax having a melting point of 70° C. were heated up to 60° C., and were dissolved and dispersed evenly by the rotation at 12000 r.p.m. on "TK HOMOMIXER" (made by TOKUSHU KIKA KOGYO Co. LTD.). Some 10 g of 2,2'-azobis (2,4-valeronitrile) was added to the foregoing to be dissolved, and thereby, polymerizable monomer composition was prepared.

On the other hand, 450 g of sodium phosphate aqueous solution with concentration of 0.1 mol/L was added to 710 g of ion-exchange water, then, 68 g of calcium chloride with concentration of 1.0 mol/L was added gradually while stirring at 13000 r.p.m. in the TK HOMOMIXER, to prepare the suspension in which tricalcium phosphate is dispersed. To this suspension, there was added the aforementioned polymerizable monomer composition, to be stirred for 20 minutes at 10000 r.p.m. in the TK HOMOMIXERr, thus, the polymerizable monomer composition was granulated.

After that, the suspension was made to react on the polymerizable monomer composition for 5–15 hours at 75–95° C. Tricalcium phosphate was dissolved by hydrochloric acid to be removed, then, classification was conducted in the solution through the centrifugal sedimentation method by the use of a centrifugal separator, to be filtered, washed and dried. One part by weight of silica fine grains was added to and mixed with 100 parts by weight of the coloring particles thus obtained by Henschel mixer and thus, the toner by an emulsion polymerization association method was obtained.

Specifically, by controlling a solution temperature, the number of rotations for stirring and heating time by monitoring in the course of preparation of the polymerizable monomer composition stated above, the coefficients of variation for the form and the shape factor are controlled, and further, by the classification in the solution, fluctuations of the particle size and particle size distribution were adjusted, and toner 1, toner 2, comparative toner a and comparative toner b shown in the following table 1 were obtained.

TABLE 1

| | | Mean particle size (μm) | Shape factor |
|---|---|---|---|
| Example 1 | Toner 1 | 5.9 | 0.955 |
| Example 2 | Toner 2 | 5.7 | 0.965 |
| Comparative Example 1 | Comparative toner **a** | 5.9 | 0.990 |
| Comparative Example 2 | Comparative toner **b** | 6.0 | 0.935 |

(Manufacture of Developing Agent)

Each toner mentioned above and a ferrite carrier that is covered by styrene-methacrylate copolymer and has a mean particle size of 60 μm were mixed at the mixture ratio of 75 g of the toner to 1425 g of the carrier, to manufacture the developing agents.

Image forming tests were made on the image forming apparatus described later under the condition of the brush roller shown in the following Table 2, by using the toner 1, toner 2, comparative toner a and comparative toner b.

In the image forming tests, images of 500,000 sheets were formed for each of the high temperature and high humidity environment, the ordinary temperature and ordinary humidity environment and the low temperature and low humidity environment, and examinations for the presence of occurrence of image defects were made. The high temperature and high humidity environment was for the temperature of 30° C. and the humidity of 80%, the ordinary temperature and ordinary humidity environment was for the temperature of 20° C. and the humidity of 50%, and the low temperature and low humidity environment was for the temperature of 10° C. and the humidity of 20%.

As an image forming apparatus, there was used a digital copying machine wherein an image is read by the scanner section and what is read is converted into digital signals to be subjected to various types of image processing, and a photoreceptor is irradiated by a laser beam to form a latent image. A linear speed difference of the photoreceptor was established to 420 mm/s. The cleaning device is composed of a rubber blade and a rotary brush roller arranged at the upstream side of the rubber blade in the rotation direction of the photoreceptor, and the rubber blade was represented by urethane rubber which was brought into contact with the photoreceptor in the opposite direction. A value of hardness of the rubber blade was set to 70°, a value of impact resilience was set to 68% (25° C.), a value of blade load was set to 22.5 gf/cm and a value of effective contact angle was set to 14°.

TABLE 2

| | Toner | Brush rollers | | | | | | |
|---|---|---|---|---|---|---|---|---|
| | types | F | n | x | y | E | t | L |
| Example 1 | Toner 1 | 5.1 | 155 | 210 | 1.0 | 650 | 0.028 | 4.5 |
| Example 2 | Toner 1 | 2.6 | 155 | 168 | 0.7 | 650 | 0.028 | 4.65 |
| Example 3 | Toner 2 | 10.3 | 155 | 294 | 1.3 | 650 | 0.028 | 4.35 |
| Example 4 | Toner 2 | 4.3 | 93 | 294 | 1.0 | 650 | 0.028 | 4.5 |
| Comparative Example 1 | Comparative Toner a | 1.0 | 155 | 42 | 1.0 | 650 | 0.028 | 4.5 |
| Comparative Example 2 | Comparative Toner b | 11.1 | 93 | 210 | 1.0 | 650 | 0.043 | 4.5 |
| Comparative Example 3 | Toner 1 | 1.0 | 155 | 42 | 1.0 | 650 | 0.028 | 4.5 |
| Comparative Example 4 | Toner 2 | 11.1 | 93 | 210 | 1.0 | 650 | 0.043 | 4.5 |
| Comparative Example 5 | Comparative Toner a | 5.1 | 155 | 210 | 1.0 | 650 | 0.028 | 4.5 |

Under the conditions of the toner types shown in Examples 1–4 and under the conditions of the brush rollers, image defects called, for example, black lines on copy and smeared image were not caused and excellent images were obtained stably and constantly, after 500000 sheets of images were formed under the high temperature and high humidity environment, the ordinary temperature and ordinary humidity environment and the low temperature and low humidity environment.

In the Comparative Example 1, cleaning failure was caused at the time when 80,000 sheets of images have been formed under the low temperature and low humidity environment. In addition, a trouble called smeared image was caused at the time when 60,000 sheets of images have been formed under the high temperature and high humidity environment.

In the Comparative Example 2, a trouble called blade bounding was caused at the time when 2,000 sheets of images have been formed under the low temperature and low humidity environment. Further, cleaning failure that is caused by breaking of edges of a rubber blade was caused at the time when 150,000 sheets of images have been formed. In addition, a trouble called gray background resulting from abrasion of a photoreceptor was caused when 200,000 sheets of images have been formed. Gray background was caused when 60000 sheets of images have been formed under the high temperature and high humidity environment.

In the Comparative Example 3, cleaning failure was caused at the time when 190,000 sheets of images have been formed under the low temperature and low humidity environment. In addition, a smeared image was caused at the time when 70,000 sheets of images have been formed under the high temperature and high humidity environment.

In the Comparative Example 4, a blade bounding was caused at the time when 3,000 sheets of images have been formed under the low temperature and low humidity environment. Further, cleaning failure that is caused by breaking of edges of a rubber blade was caused at the time when 170,000 sheets of images have been formed.

In the Comparative Example 5, cleaning failure was caused at the time when 130,000 sheets of images have been formed under the low temperature and low humidity environment.

As the aforementioned results show, it has been confirmed that images with high image quality can be obtained stably, when number average particle diameter of the toner particles is in a range of 3–8 $\mu$m, a shape of factor is in a range of 0.940–0.985, and a value of effective rubbing force F by a group of brush fibers which come in contact with a photoreceptor is in a range of 2.5–10.5.

The image forming apparatus of the invention makes it possible to form constantly excellent visible images without image defects, by using toner satisfying specific conditions and by employing a cleaning means equipped with a brush roller operated under the specific condition.

What is claimed is:

1. An image forming apparatus comprising:

a photoreceptor for forming a latent image on a surface thereof;

a developing section for developing the latent image to form a toner image;

a transferring section for transferring the toner image onto a recording material; and a cleaning section for removing a residual toner from the surface of the photoreceptor, wherein the toner is manufactured by a method in which a polymerizable monomer is polymerized in an aqueous medium, a number average particle diameter of the toner is in a range of 3–8 $\mu$m, and a shape factor of the toner is in a range of 0.940–0.985; wherein, the cleaning section comprises a rubber blade coming in contact with the surface of the photoreceptor, and a brush roller implanted with brush fibers, the brush roller rotates while the brush fibers contacting with the surface of the photoreceptor under the state of having a linear speed difference against the surface of the photoreceptor, wherein, a value of effective rubbing force F, defined by the following expression (1), of brush fibers of the brush roller contacting the surface of the photoreceptor is in a range of 2.5–10.5;

$$F=nxyEt^3/L^3 \qquad \text{expression (1)}$$

wherein,

"n" represents implanted density of the brush fibers (number of fibers/mm$^2$),

"x" represents a linear speed difference between the brush fibers and the photoreceptor (mm/s), "y" represents an amount of encroaching (mm) of the brush fibers upon the photoreceptor, "E" represents Young's modulus (kgf/mm$^2$) of the brush fibers, "t" represents a diameter (mm) of a brush fiber in the brush fibers, and "L" represents a free length (mm) of the brush fibers.

2. The image forming apparatus of claim 1, wherein the electrical resistance of the brush fiber is not greater than $10^{10}$ Ω.cm.

3. The image forming apparatus of claim 1, wherein the implanted density "n" of the brush fibers is in a range of 50–200 fibers/mm$^2$.

4. The image forming apparatus of claim 1, wherein the diameter "t" of the brush fiber is in a range of 0.01–0.05 mm.

5. The image forming apparatus of claim 1, wherein the free length "L" of the brush fiber is in a range of 3–10 mm.

6. The image forming apparatus of claim 1, wherein the amount of encroaching "y" of the brush fibers upon the photoreceptor is in a range of 0.5–1.5 mm.

7. The image forming apparatus of claim 1, wherein the Young's modulus "E" of the brush fibers is in a range of 500–1000 kgf/mm$^2$.

8. The image forming apparatus of claim 1, wherein the linear speed difference (mm/s) between the brush fibers and the photoreceptor is in a range of 20–500 mm/s.

* * * * *